US005809896A

United States Patent [19]

Gersemsky

[11] Patent Number: 5,809,896

[45] Date of Patent: Sep. 22, 1998

[54] RUNNING GEAR FOR CHAIN HOISTS

[75] Inventor: Udo Gersemsky, Herdecke, Germany

[73] Assignee: Mannesmann Aktiengesellschaft, Düsseldorf, Germany

[21] Appl. No.: 838,162

[22] Filed: Apr. 16, 1997

[30] Foreign Application Priority Data

Apr. 19, 1996 [DE] Germany ..... 196 17 099.0
May 9, 1996 [DE] Germany ..... 196 20 150.0

[51] Int. Cl.[6] ..... B61B 3/02

[52] U.S. Cl. ..... 104/93; 104/95; 104/107; 105/150; 105/154

[58] Field of Search ..... 104/89, 93, 95, 104/106, 107, 104; 105/148, 150, 154

[56] References Cited

U.S. PATENT DOCUMENTS

| | | | |
|---|---|---|---|
| 3,064,585 | 11/1962 | Ewing, Jr. | 104/93 |
| 3,149,580 | 9/1964 | Ewing, Jr. | 104/93 |
| 3,568,605 | 3/1971 | Pettit | 104/95 |
| 4,715,288 | 12/1987 | Catena | 104/95 |

FOREIGN PATENT DOCUMENTS

| | | | |
|---|---|---|---|
| 2 318 099 | 2/1977 | France . | |
| 1 927 583 | 7/1965 | Germany . | |
| 1 956 894 | 10/1966 | Germany . | |
| 41 09 971 | 9/1992 | Germany . | |
| 221943 | 9/1987 | Japan | 104/95 |
| 12819 | 4/1925 | Netherlands | 105/154 |
| 1481150 | 5/1989 | U.S.S.R. | 104/95 |
| 2059894 | 4/1981 | United Kingdom | 104/95 |

*Primary Examiner*—S. Joseph Morano
*Attorney, Agent, or Firm*—Cohen, Pontani, Lieberman & Pavane

[57] ABSTRACT

A running gear, in particular for chain hoists, load carrying and/or trailing cable, which includes a running rail comprising flange parts and a web part. Running wheels which are located opposite one another are supported on the flange parts of the running rail and guide rollers which are arranged on both sides in front of and behind each running wheel are vertically supported on the web part of the running rail. The guide rollers are rotatably supported in lateral wheel carriers connected below the running rail, at least one of the wheel carriers having a load suspension device connected thereto. Trapezoidally-shaped guide grooves conduct the guide rollers as the running gear moves longitudinally along the rail. The guide rollers have rounded edges which contact only a portion of the guide groove. Thus, the running gear moves steadily along the rail while the pitching and swaying movements which typically accompany the pendulum-like movement of the load are not transferred to the running gear.

9 Claims, 2 Drawing Sheets

RUNNING GEAR FOR CHAIN HOISTS

BACKGROUND OF THE INVENTION

1. Field of the Invention

The present invention relates to a running gear, and more particularly to a running gear including a running rail having flange parts and a web or web part and running wheels and guide rollers rotationally arranged about the flange and web parts.

2. Description of the Related Art

German Patent Number DE 41 09 971 A1 discloses a running gear with running wheels on both sides of an I-shaped running rail contacted on one side by front and rear lateral guide rollers which are mounted on vertical axles. This running gear also travels on the support rail in a stable manner when exposed to loads swinging in a pendulum-like manner. In critical situations, however, the running gear tends to pitch and rock in a pendulum-like manner.

SUMMARY OF THE INVENTION

It is accordingly an object of the present invention to provide a running gear, in particular for chain hoists, load carrying means and the like, which is rollingly suspended for longitudinal movement at and along a running rail comprising flange parts and a web or web part. Two running wheels, arranged horizontally on opposite sides of the web, rollingly support the running gear as it moves longitudinally along the running rail. Guide rollers are arranged in front of and behind each running wheel in the direction of movement and prevent the running gear from pitching or swaying type movements or from lateral pendulum-like motion caused by a load swinging in a pendulum-like manner. The running wheels and guide rollers are rotatably carried in two arm-like wheel carriers that are articulably connected at an axle; the axle extending and in vertically spaced relation with and along the running rail. A load suspension device is connected to and suspended from at least one of the wheel carriers.

In the present invention, at least a portion of the guide rollers are navigated on guides arranged between the flanges and extending at least on one side at the web longitudinally with the rail. This arrangement enables stable running or substantially horizontal longitudinal movement on the running rail particularly when loads are moving in a pendulum-like manner; this pitching movements and lateral pendulum-like movement of the running gear are effectively prevented by the guides and the guide rollers.

The guides are preferably constructed as guide grooves to simplify production, and the running rail may, for example, be produced by extrusion or other similar manufacturing methods.

In a preferred embodiment, the contour of the guide grooves complements the shape of the guide rollers. As a result, the running gear of the present invention guides the load along the rail quietly and steadily.

In a further embodiment of the present invention, the cross-sectional shape of the guide grooves is substantially trapezoidal so as to additionally reduce wear on the guide rollers as far as possible. It is further suggested, in particular, that the edges of the guide rollers be rounded so that they run only on the sloped side surfaces of the trapezoidal guide grooves. Consequently, the guide rollers only partially contact the guide grooves thereby reducing the rolling resistance of the guide rollers.

The rounded edges of the guide rollers and the trapezoidal shape of the guide grooves are configured so that the guide rollers contact only the sloped side surfaces of the trapezoidal guide grooves, leaving an intermediate space between the guide rollers and the middle region (between the sloped side surfaces) of the respective guide groove.

Running or substantially horizontal movement of the running gear is improved in that arms of the wheel carriers are supported in pairs so as to be swivelable about an axle extending in the longitudinal direction of and under the running rail, enabling the pairs of arms to swivel open and shut. At the height of or below the articulable connection between the arms of the wheel carriers, a load acts on at least one of the arms so that both arms are held closed or shut, i.e. encouraged toward each other in a defined manner, by a closing moment of the guide rollers that originates in the load and causes the guide rollers to contact both sides of the web in the guides.

The horizontally mounted guide rollers are configured and positioned to contact the running rail in pairs at opposing sides of the web, and are forcibly encouraged into such contacting engagement by a force that is preferably transmitted from the load carrying means through the wheel carrier to the guide rollers.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
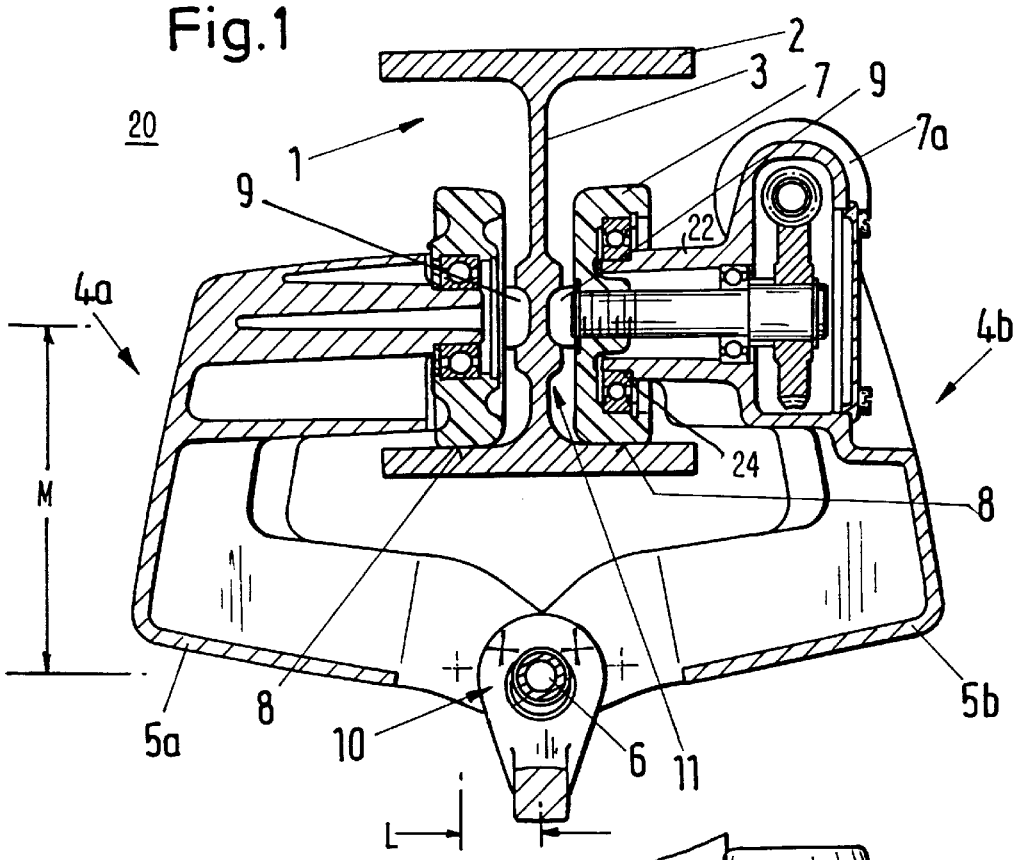
FIG. 1 is a cross-sectional front view of a running gear configured in accordance with the present invention.

FIG. 1 depicts a cross-sectional front view of a running gear generally designated 20 including a running rail 1 which is formed of flange parts 2 and a web or web part 3. The running rail 1 is substantially I-shaped in cross-section and defines a substantially horizontal longitudinal direction of movement. The running gear 20 includes two arm-like wheel carriers 4*a*, 4*b* forming frames 5*a*, 5*b*. The frames 5*a*, 5*b* are articulably joined at an axle 6 disposed below and extending longitudinally with the running rail 1. The frames 5*a*, 5*b* are swivelable about the axle 6 at an articulation 10 between an open and a closed position. In an alternative embodiment the frames 5*a*, 5*b* are rigidly connected with one another in a fixed position. Moreover, it is conceivable to combine these two variants, wherein the swivelable frames 5*a*, 5*b* are fixed in position after moving from an open to a shut position, for example, thereby producing a semi-rigid connection between the frames 5*a*, 5*b* and the running rail 1.

Figure 2:
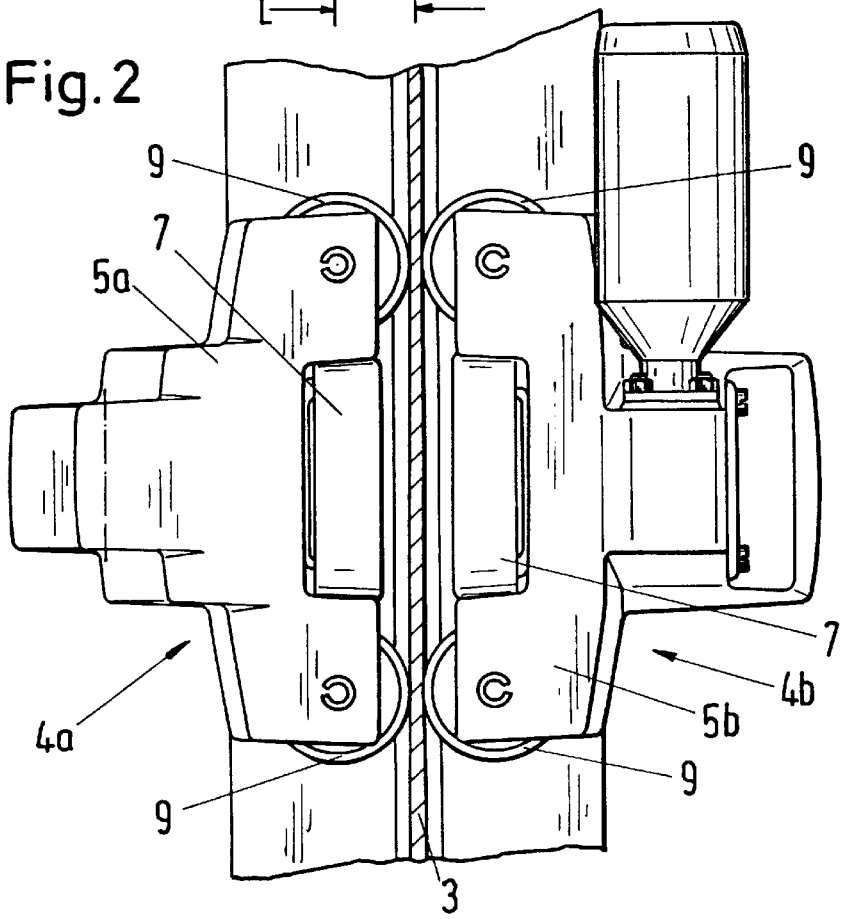
FIG. 2 is a top view of the running gear of FIG. 1.

A pair of vertically oriented running wheels 7 are mounted opposite each other and arranged in the upper region of the frames 5*a*, 5*b*. The running wheels 7 are rotatably mounted on a journal portion 24 of a substantially horizontal extension 22 of the wheel carriers 4*a*, 4*b* which is substantially horizontal and supported in the frames 5*a*, 5*b*. One of the running wheels 7 is preferably driven directly by a motor 7*a* to assist the longitudinal movement of the running gear along the rail 1. The running wheels 7 rollingly contact the lower running surfaces 8 of the flange part 2. The frames 5*a*, 5*b* also support horizontally mounted guide rollers 9 which are arranged in pairs; one guide roller 9 in front of and one guide roller 9 behind the running wheels 7 when viewed in the longitudinal direction of movement of the running gear 20. These guide rollers 9 are supported in the frames 5*a*, 5*b* for rotation about a substantially vertical axis. While the running wheels 7 are rollingly supported on the lower running surface 8 of the flange parts 2, the guide rollers 9 rollingly contact the web 3 of the running rail 1 in pairs; one guide roller 9 disposed on either side of web 3 (see FIG. 2).

As seen in FIG. 1, the frames 5*a*, 5*b* are swivelable about articulation 10 inward over the respective flange part 2 of the running rail 1 until the running wheels 7 move directly into the vicinity of the web 3. A load is preferably connected to one of the frames 5*a*, 5*b* and acts on the axle 6 at the height of the articulation 10 formed between the frames 5*a*, 5*b*; thus, articulation 10 simultaneously forms an articulation point between the two frames 5*a*, 5*b* and the suspension point for the load.

The load produces a substantially downward (as viewed in FIG. 1) force at articulation 10 and generates a closing moment in the frames 5*a*, 5*b* that causes the frames 5*a*, 5*b* to swivel toward the closed position and forces the guide rollers 9 to be rollingly held in contact with the web 3. The angular position between the frames 5*a*, 5*b* when in the closed position is defined in FIG. 1 by the guide rollers 9 contacting both sides of the web 3; the contacting of the guide rollers 9 is effected in that the latter are acted upon by force originating from the load itself.

With continued reference to FIG. 1, lateral guides 11 for the guide rollers or wheels 9 are formed as guide grooves 11*a* (see FIG. 3) at the web 3 and extend longitudinally with the rail 1; the guide rollers 9 are rollingly held and guided in the guide grooves 11*a* accompanied by the force of the load to produce a stable running gear 20.

Figure 3:
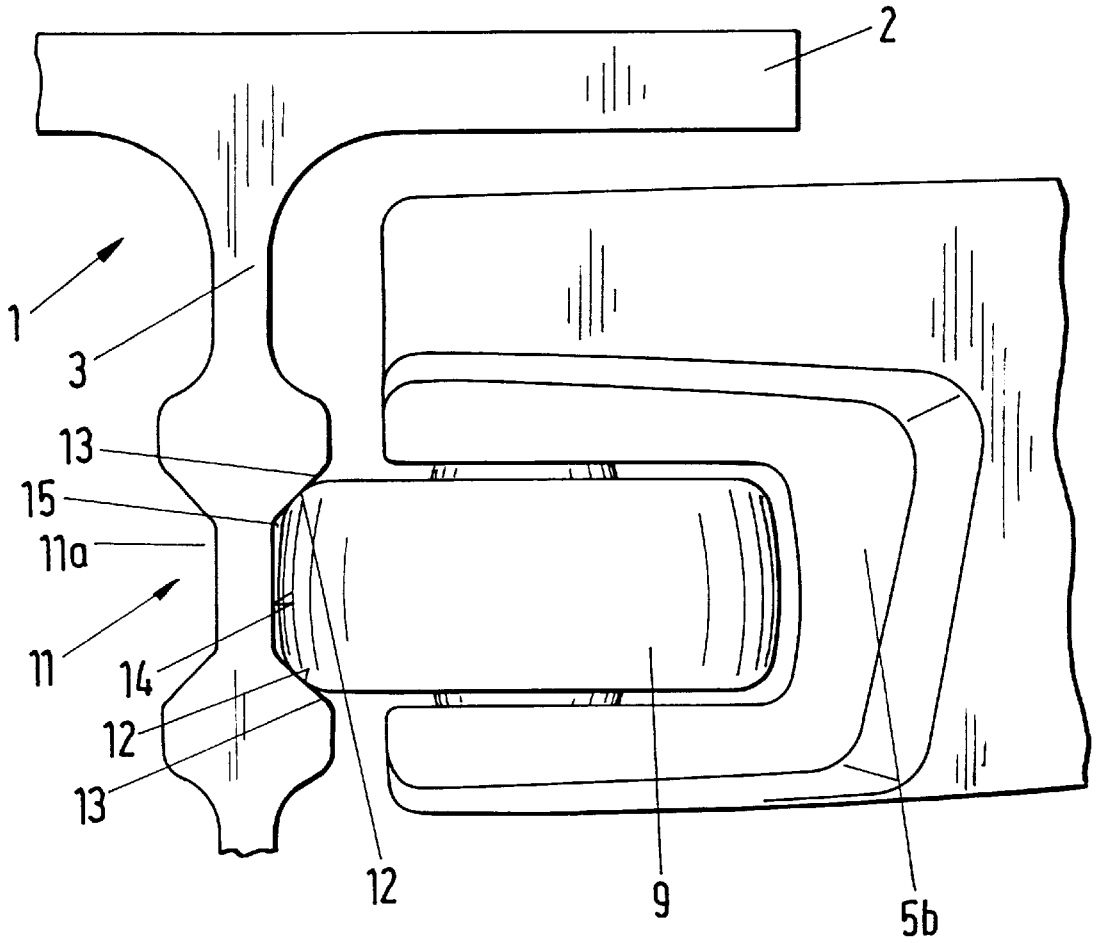
FIG. 3 is an enlarged section of the guide grooves together with the guide rollers of the running gear of FIG. 1.

Referring next to FIG. 3, the guide grooves 11*a* and a guide roller 9 are shown in enlarged cross-section with the guide roller 9 being configured for minimal interfering engagement with the guide grooves 11*a*. As seen in FIG. 3, the cross-section of the guide grooves 11*a* is substantially trapezoidal with two sloping side portions 13 and a trapezoidal roof 14. The guide rollers 9 preferably include rounded edges 12 which are configured to contact and run on and along the side portions 13 of the trapezoidal guide grooves 11*a*, particularly so as to leave open an intermediate space 15 between the middle region of the guide wheel 9 and trapezoidal roof 14. Since the contact surfaces between the guide wheel 9 and guide groove 11*a* are relatively small, the rolling resistance of the running gear 20 is consequently reduced. Of course, it is also possible to contour the guide groove 11*a* so that it virtually complements the shape of the guide rollers 9. While this embodiment will improve the guiding accuracy of the running gear 20, it also increases the rolling resistance of the guide rollers 9. In a further alternative embodiment, the running wheels 7 disposed on opposite sides of the rail 1 are arranged offset relative to one another in the longitudinal direction of travel.

As seen in FIG. 1, the axes of the running wheels 7 are vertically spaced apart from the axle 6 by a distance M. In addition, the running wheels are horizontally spaced apart from the axle by a distance L. In a preferred embodiment, the ratio of vertical distance M to horizontal distance L is approximately greater than 3 and approximately less than 10.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A running gear for a load carrying device having a load suspension device for carrying a load, comprising:

an elongated rail with flange parts and a web part having oppositely disposed sides;

two lateral wheel carriers connected to each other at a location vertically spaced apart from said rail, one of said wheel carriers carrying the load suspension device;

a running wheel arranged on each of said wheel carriers on opposite sides of said web and supported on said flange parts;

a pair of guide rollers rotatably mounted in said lateral wheel carriers and disposed in substantially horizontally spaced apart relation about each of said running wheels, said guide rollers being vertically supported on said web part; and a guide at least partially extending on at least a side of said web in a longitudinal direction for at least partially guiding said guide rollers, wherein said guide is configured as a guide groove.

2. The running gear of claim 1, wherein said guide groove has a first predetermined shape, and wherein said guide rollers have a second predetermined shape, said first shape and said second shape being complementary to each other.

3. The running gear of claim 2, wherein said first predetermined shape is substantially trapezoidal in cross-section.

4. The running gear of claim 3, wherein said guide rollers each include rounded edges.

5. The running gear of claim 4, wherein said guide groove includes diagonal surfaces and a roof portion disposed therebetween, said rounded edges of said guide rollers encountering said diagonal surfaces such that a space is defined between said roof portion and said guide rollers.

6. The running gear of claim 1, wherein said guide rollers are encouraged into vertically supported contact with said web part by the load carried by said running gear.

7. The running gear of claim 1, further comprising an axle extending in a longitudinal direction in spaced apart relation to said rail, said lateral wheel carriers being configured in pairs and each having arms, said pairs being swivelably connected to each other at said axle thereby defining an articulation and being swivelable between a shut position in which said guide rollers contact both sides of said web part in said guides, and an open position, which is out of said shut position, wherein the load acts on at least one of said arms of said wheel carrier to define a closing moment that originates in the load.

8. The running gear of claim 1, wherein said running wheels are offset relative to one another in said longitudinal direction.

9. The running gear of claim 1, further comprising an axle defining a first substantially horizontal axis extending in a longitudinal direction in spaced apart relation to said rail, said lateral wheel carriers being connected to each other at said axle, said running wheels being mounted on said lateral wheel carriers for rotation about a second substantially horizontal axis, said running wheels defining a substantially vertical plane that traverses centrally therethrough, said second horizontal axis being disposed vertically apart from said first horizontal axis by a first predetermined distance, said vertical plane being disposed horizontally apart from said first horizontal axis axle by a second predetermined distance, the ratio of said first distance to said second distance being approximately greater than three and approximately less than ten.

* * * * *